United States Patent [19]

Arai

[11] 4,059,358

[45] Nov. 22, 1977

[54] PRESSURE COATING ROLLER ASSEMBLY

[75] Inventor: Kazuo Arai, Tokyo, Japan

[73] Assignee: Iwata Air Compressor Mfg. Co., Ltd., Tokyo, Japan

[21] Appl. No.: 692,581

[22] Filed: June 3, 1976

[30] Foreign Application Priority Data

July 2, 1975 Japan ..... 50-93178[U]

[51] Int. Cl.[2] ..... B43M 11/02; B44D 3/28

[52] U.S. Cl. ..... 401/219; 239/521

[58] Field of Search ..... 401/188, 206, 190, 137–139, 401/219; 239/521, 524

[56] References Cited

U.S. PATENT DOCUMENTS

| | | | |
|---|---|---|---|
| 1,085,120 | 1/1914 | Gibbs | 239/521 X |
| 1,151,244 | 8/1915 | Carter | 239/521 |
| 1,364,163 | 1/1921 | Wampler | 239/521 X |
| 3,196,479 | 7/1965 | Romoser | 401/208 |
| 3,340,562 | 9/1967 | Skandaliaris | 401/219 |
| 3,591,091 | 7/1971 | Galloway et al. | 239/524 X |

*Primary Examiner*—Stephen C. Pellegrino
*Attorney, Agent, or Firm*—Wenderoth, Lind & Ponack

[57] ABSTRACT

A pressure coating roller gun has a spray nozzle having a spray opening formed in front of the central jet orifice, the opening having a bevel impingement wall. By the use of this nozzle, a coating material is sprayed in the form of a divergent thin film over the coating roller surface. The coating roller preferably has a length corresponding to the width of the divergent thin film of coating material sprayed from the spray nozzle. A spherical coupling member is provided at the proximal end of the spray nozzle so as to allow free adjustment of the direction of spray.

4 Claims, 3 Drawing Figures

PRESSURE COATING ROLLER ASSEMBLY

BACKGROUND OF THE INVENTION

This invention relates to a pressure coating roller assembly designed for use in roller coating by automatically feeding the coating material to the roller.

There are known and used generally various types of roller coating devices using a roller or rollers, the surface of which is covered with a layer of sponge, cloth, fur or other raised fabric material and impregnated with a coating material so as to spread the coating material on an object to be coated. For performing the coating operation at high efficiency in these types of coating devices, it is highly desirable to make an arrangement such that the coating material is automatically supplied to the roller to allow for a continuous coating operation.

For feed of the coating material in these types of roller coating system, there are generally employed the following two feed systems: an internal feed system in which the coating material is first supplied into the hollow inside of the roller and then passed through a plurality of small holes opening from the inside to the outside of the roller so that the coating material is impregnated in the external sponge or other roller surface layer, and an external feed system in which one or more coating material jet orifices are provided in opposition to the external surface of the roller and the coating material supplied under pressure is ejected from such orifices to the roller surface so that the coating material is impregnated in the sponge or other surface layer of the roller. In the former system, however, since the coating material is fed into the inside of the roller, the roller weight increases to an extent as to result in reduced workability. This system also involves the difficulty and trouble of cleaning the inside of the roller. In the latter system, on the other hand, difficulty is encountered in attaining uniform feed of the coating material to the roller surface. The conventional feed systems present the problems of nonuniform spreading and scattering of the coating material from the roller to soil the surrounding areas.

SUMMARY OF THE INVENTION

In view of the above circumstances, the object of the present invention is to provide a pressure coating roller assembly which is simple and easy to handle, which is free of the above prior art problems and which will provide a great benefit to the industry concerned.

Thus, there is provided according to this invention a pressure coating roller assembly of the external feed type in which the coating material jetted from a single circular jet orifice hits against a bevel wall disposed forwardly thereof to form a divergent thin film of coating material so that the coating material is supplied in a thin film form to the roller surface. The direction of spray of the coating material can be adjusted as desired. A spray nozzle having the jet orifice and a roller are assembled integrally, and this integral assembly is detachably secured to the grip which has a valve unit housed therein.

BRIEF DESCRIPTION OF THE DRAWINGS

The present invention will now be described in detail by way of an embodiment thereof with reference to the accompanying drawings in which.

DETAILED DESCRIPTION OF THE INVENTION

Figure 1:
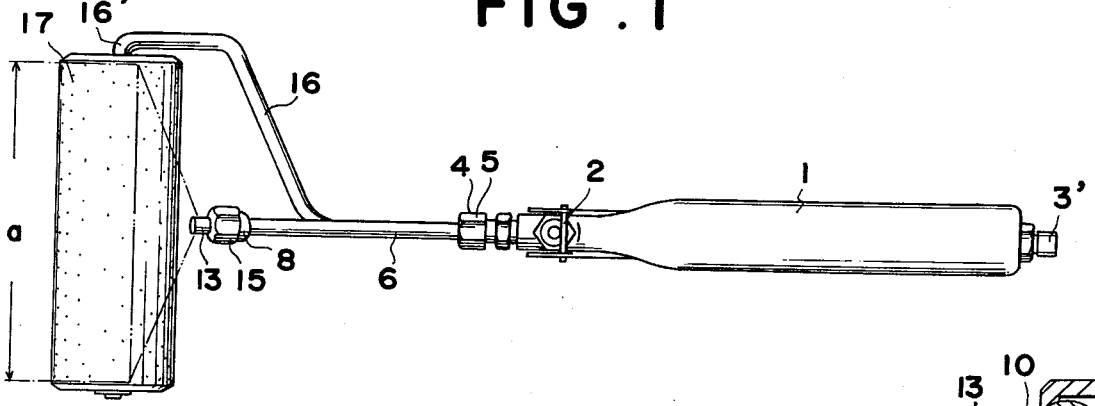
FIG. 1 is a plan view of the invention.
Figure 3:
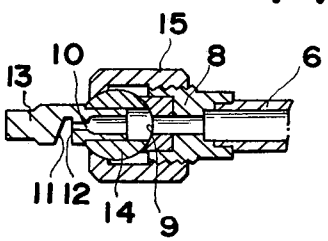
FIG. 3 is an enlarged sectional view of the essential portion of the spray nozzle.
Figure 2:
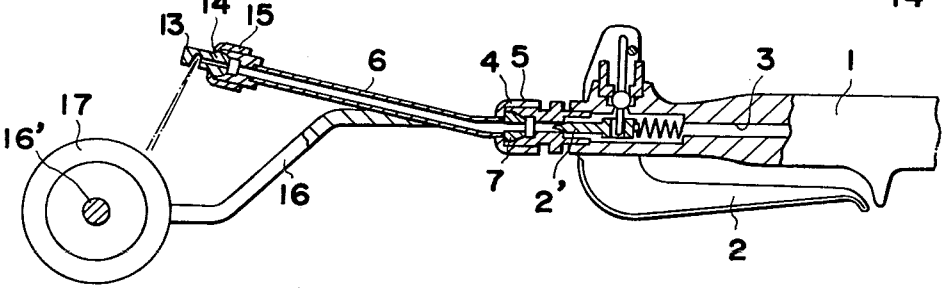
FIG. 2 is a side view, with parts cut away, of the principal mechanism of the invention.

Referring generally to the drawings, reference numeral 1 indicates the grip of the device having extending therethrough a coating material supply hole 3 and provided at an end thereof with a trigger 2. At the joint 5 comprising a cap nut 4 fixed to the end of grip 1 is secured a fixing seat 7 at the proximal end of a supply pipe 6 which projects outwardly therefrom at an inclination along a certain length. At the end of supply pipe 6 is provided a connecting member 8 having therein an arcuate receiving groove 9. Fitted in receiving groove 9 is a spherical coupling member 14 disposed at the proximal end of a spray nozzle 13 formed with a downwardly directed spray opening 12 having a bevelled impingement wall 11 in front of a central jet orifice 10. The outer edge of spherical coupling member 14 is engaged and fastened by the opening edge of a cap nut 15 which is threadedly engaged with the connecting member 8. Numeral 16 indicates a support rod branching off from the proximal end of the supply pipe 6 extending from the grip 1, with the end of support rod 16 being bent to form a U-shaped configuration. It will also be seen that a coating roller 17 having its surface covered with a raised fabric, sponge or other paint-impregnatable material is rotatably mounted on the cross shaft portion 16' at the end of support rod 16, portion 16' being disposed transverse to the grip 1. The length of roller 17 is selected in conformity to the width *a* of the divergent thin film of coating material sprayed from the spray opening 12 of the spray nozzle 13 located at a position above roller 17.

In the use of the present invention for spraying paint, first an end of a guide hose connected at its other end to a pressurized paint feed device such as an airless pump set at its proximal end to a paint tank is joined to the inlet 3' at the open end of the paint supply hole 3 in the grip body 1. Then, if the operator pulls the trigger 2 of the grip 1, the paint is forced into the supply pipe 6 with its flow rate being suitably controlled by a valve unit 2' provided in the trigger mechanism and then is jetted out from the jet orifice 10 of the spray nozzle 13 connected to the end of supply pipe 6. The jetted paint dashes against the bevel wall 11 of the opening 12 in front of the jet orifice 10 and spreads along such wall surface to form a divergent thin film of paint so that the paint is sprayed in the form of such divergent thin film. Thus, since the paint is sprayed in the form of a continuous thin film over the entire span of the coating roller 17 disposed below the spray opening 12 of the spray nozzle 13, the paint is applied uniformly on the roller surface and hence desired coating can be accomplished on an object to be coated by rolling roller 17 on the object surface.

As described above, the present invention features detachable joining of a supply pipe to the grip having a trigger unit, the supply pipe having branched off therefrom a support rod mounting a coating roller at its end, and it also employs an external feed system in which a spherical coupling member disposed at the proximal end of the spray nozzle having its jet orifice directed toward the coating roller is secured to the end of the supply pipe, so that the operator can visually observe the degree of impregnation of the coating material on the roller surface and therefore the coating work is greatly facilitated. Also, since the roller used in this invention is selected such that its length will just correspond to the width of the divergent thin film of coating material sprayed from the spray opening, there is little possibility that superfluous coating material will be scattered to surrounding areas, and a stabilized paint supply is ensured. Further, as to the proximal end of the spray nozzle is rotatably set by means of a spherical coupling member to allow suitable adjustment of the direction of the spray from the spray opening, the device can be accommodated to a wide variety of conditions, e.g. the size of the roller, the type of coating material, the spray rate, etc. It should be particularly noted that this type of spray nozzle can provide a wide angle of divergence so that very effective spraying can be accomplished from a position close to the roller. Moreover, since the supply pipe is detachably joined to the grip, it is possible to insert a separate connection pipe or pipes between the supply pipe and the grip to allow coating on a spot remote from the operator.

What is claimed is:

1. A pressure feed coating roller and spray gun assembly attachable to an external pressurized source of coating material, said assembly comprising:

a coating roller;

a spray nozzle mounted in predetermined spaced relationship to said coating roller;

said spray nozzle including a jet orifice through which a jet of coating material passes and bevelled surface means facing said jet orifice and against which said jet of coating material impinges for diverting said jet toward the surface of said coating roller in the form of a thin, substantially flat spray which diverges laterally outwardly in a direction parallel to the longitudinal axis of said coating roller; and the length of said coating roller being equal to the laterally divergent width of said spray at the position of contact of said spray with said surface of said coating roller.

2. An assembly as claimed in claim 1, wherein said jet orifice and said bevelled surface means are fixed relative to each other, and wherein said spray nozzle is mounted in a spherical coupling member, whereby the direction of said spray is freely adjustable.

3. An assembly as claimed in claim 1, wherein said coating roller and said spray nozzle are combined into an integral unit, and further comprising a grip having means for attachment to a pressurized source of coating material, means for removably attaching thereto said unit, and valve means for selectively supplying coating material to said spray nozzle of said unit.

4. An assembly as claimed in claim 3, wherein said unit further includes a supply pipe, first removable coupling means for attaching a first end of said supply pipe to said grip, second removable coupling means for attaching said spray nozzle to a second end of said supply pipe, and a support rod integral with said supply pipe and extending therefrom, said coating roller being supported on said support rod.

* * * * *